US008961106B2

(12) United States Patent
Hamochi

(10) Patent No.: US 8,961,106 B2
(45) Date of Patent: Feb. 24, 2015

(54) TURBOMOLECULAR PUMP AND CONNECTOR DEVICE THEREFOR

(75) Inventor: Mitsuru Hamochi, Tokyo (JP)

(73) Assignee: JEOL Ltd., Tokyo (JP)

( * ) Notice: Subject to any disclaimer, the term of this patent is extended or adjusted under 35 U.S.C. 154(b) by 696 days.

(21) Appl. No.: 13/291,307

(22) Filed: Nov. 8, 2011

(65) Prior Publication Data

US 2012/0128484 A1 May 24, 2012

(30) Foreign Application Priority Data

Nov. 22, 2010 (JP) ..... 2010-259826

(51) Int. Cl.
*F04D 19/04* (2006.01)
*F04D 29/60* (2006.01)

(52) U.S. Cl.
CPC ..... *F04D 19/042* (2013.01); *F04D 29/601* (2013.01)
USPC ..... 415/90; 415/119

(58) Field of Classification Search
USPC ..... 415/90; 416/145; 417/423.4
See application file for complete search history.

(56) References Cited

U.S. PATENT DOCUMENTS 4,346,782 A * 8/1982 Bohm ..... 181/207

FOREIGN PATENT DOCUMENTS

JP 2000073986 A * 3/2000
JP 2003004099 A * 1/2003
JP 2004360784 A 12/2004
JP 2007165232 A 6/2007
JP 2008232029 A 10/2008

OTHER PUBLICATIONS

JP 2000-73986 A Machine Translation, Aug. 6, 2014, 4 Pages.*

* cited by examiner

*Primary Examiner* — Richard Edgar
(74) *Attorney, Agent, or Firm* — The Webb Law Firm

(57) ABSTRACT

A connector device for coupling a turbomolecular pump to an apparatus to be pumped. The connector device can suppress transmission of vibrations of relatively low frequencies. The pump has a rotor, a casing accommodating the rotor therein, and an intake port and an outlet port formed in the casing. The pump operates to suck gas from the intake port and to expel the gas from the outlet port by rotating the rotor within the casing at high speed. The connecting device has a connecting exhaust tube for connecting the intake port of the turbomolecular pump with the outlet port of the apparatus (such as a vacuum vessel) to be pumped. An annular weight is disposed around the outer periphery of the connecting exhaust tube. A viscoelastic member is interposed between the connecting exhaust tube and the weight to form a vibration absorber.

6 Claims, 5 Drawing Sheets

TURBOMOLECULAR PUMP AND CONNECTOR DEVICE THEREFOR

BACKGROUND OF THE INVENTION

1. Field of the Invention

The present invention relates to a connector device used to couple a turbomolecular pump (TMP) to a vacuum chamber to be pumped and, more particularly, to a TMP connector device capable of sufficiently suppressing transmission of vibrations of relatively low frequencies produced by a TMP to a vacuum chamber.

2. Description of Related Art

Apparatus that require high vacuum such as electron microscope and charged particle beam lithography systems employ vacuum pumps such as oil diffusion pump (DP) and turbomolecular pump (TMP). In recent years, oil used in oil diffusion pumps has been seen as a problem because the oil is released as a vapor into a vacuum to thereby contaminate objects to be inspected or machined.

Therefore, in order to obtain a clean vacuum, TMPs have been increasingly used. As is well known in the art, a TMP performs vacuum pumping by expelling gaseous molecules by turbine blades mounted to a rotor that rotates at high speed. Consequently, vibrations of the rotational frequency of the rotor are produced. However, vibrations generated from the TMP are not limited to this type of vibrations. A resonance having the natural frequency of the turbine blades brings about vibrations. In addition, in a case where a rotor is supported by a magnetic bearing to provide low vibrations, positional control of the rotor results in vibrations.

FIG. 5 shows a conventional structure of a TMP. This pump 1 has a casing 30 that is a closed container. A rotor 31 to which a multiplicity of turbine blades are mounted is accommodated within the casing 30. The casing 30 has an intake port 32 that opens into its end surface lying in the direction of extension of the axis of rotation 0 of the rotor 31. Furthermore, the casing 30 has an intake flange 2 for connecting the intake port 32 to an apparatus (such as an electron microscope) to be pumped. An outlet port 33 is formed in the side surface of the casing 30.

The intake flange 2 is coupled to a flange 3 of the body of the apparatus into which the outlet port of the apparatus to be pumped opens, via a bellows 4 that is a connective exhaust tube. The bellows 4 has flanges on both ends for connection with the flanges 2 and 3. A vibration-absorbing member 5, as made of rubber, is disposed around the bellows 4. The vibration-absorbing member 5 and the bellows 4 cooperate to constitute a vibration isolator 6. When the bellows 4 is mounted to the intake flange 2 and to the flange 3 of the body, O-ring seals 9*a* and 9*b* are sandwiched and clamped between the flange 3 of the body and the flange of the bellows using clamps 7 and 8 (clamps a and b).

FIG. 6 shows a spectrum of vibrations produced by a TMP. Frequency (in Hz) is plotted on the horizontal axis on a logarithmic scale. Acceleration is plotted on the vertical axis on a logarithmic scale. Vibrations are produced in both horizontal and vertical directions as viewed in FIG. 5. In the following description, only vibrational components in the vertical direction are treated. The same principle applies to vibrational components in the horizontal direction. A vibrational peak 11 of a TMP rotational frequency component is observed at a rotational frequency $f_R$ (from about 600 Hz to 1 kHz or higher) which differs according to the type or manufacturer of the TMP.

The component due to the resonance at the natural frequency 12 of the turbine blades is observed at the natural frequency $f_B$ of the turbine blades. Generally, this is lower than the rotational frequency $f_R$ of the TMP and on the order of 200 Hz. Furthermore, consideration is given to prevent the frequencies $f_R$ and $f_B$ agree; otherwise, great vibrations would take place. Where the rotor is supported by a magnetic bearing, control of the position of the rotor induces vibrations. In the example of FIG. 6, for the sake of simplicity of illustration, this is shown as a wide-band component 13 having a constant amplitude of A in a region of tens of Hz or higher. In practice, some TMPs show sharp peaks rather than components covering wide-frequency ranges.

FIG. 7 shows an example of vibration transfer function in the vertical direction of a configuration having the vibration isolator 6 shown in FIG. 5. Frequency (in Hz) is plotted on the horizontal axis on a logarithmic scale. Vibration transmissibility (in dB) is plotted on the vertical axis on a logarithmic scale. The mass of the TMP 1 and the spring constant in the direction of elongation and contraction of the vibration isolator 6 together form a vibration system. The transmissibility increases due to the resonance amplification at the resonant frequency $f_C$ of the vibration system. As the frequency is increased further, the transmissibility drops.

FIG. 8 shows a spectrum of vibrations which are produced by a TMP and shown in FIG. 6 when the vibrations are transmitted to an apparatus to be pumped via the vibration isolator 6 having the vibration transfer function shown in FIG. 7. Frequency (in Hz) is plotted on the horizontal axis on a logarithmic scale. Acceleration is plotted on the vertical axis on a logarithmic scale. Because of the aforementioned characteristics, i.e., the transmissibility decreases with increasing frequency, a large proportion of the TMP rotational frequency component 11 is removed at the TMP rotational frequency $f_R$ that is a relatively high frequency. The amount of vibrations transmitted to the flange of the body is suppressed sufficiently. However, vibrations of the natural frequency $f_B$ of the turbine blades that is a relatively low frequency are relatively large. Furthermore, the vibration transmissibility of the low-frequency, wide-band component 13 induced by the control of the magnetic bearing is relatively large.

A small vibration isolator of this type is disclosed (see, for example, in JP-A-2004-360784 (paragraphs 0014-0018; FIGS. 1 and 2)), and includes a first covering having a bottomed peripheral wall and a second covering having a bottomed peripheral wall that is smaller in diameter than that of the first covering. The first and second coverings are disposed opposite to each other such that their peripheral walls are made to overlap each other to form an interior covering space. A coil spring that biases the first and second coverings away from each other to support the static load of an object which should be made vibration-free is mounted in the covering space. Also, a pillar-like viscoelastic member is mounted in the coil spring (hence within the covering space) coaxially with the coil spring to attenuate vibrations by compressive deformations and tensile deformations in the direction of the axis.

Additionally, a pumping device is known which has a pump flange coupled to the pump, an apparatus to be pumped, an apparatus flange coupled to the apparatus, a bellows mounted between the apparatus flange and the pump flange, and a rubber member mounted between the apparatus flange and the pump flange (see, for example, in JP-A-2008-232029 (paragraphs 0045-0048; FIGS. 1 and 2)). There are n grooves formed in the outer periphery of the bellows. Parts of a resilient material are disposed in m of the n grooves.

Further, a charged particle beam system having a charged particle beam instrument including an electron optical system for directing an electron beam or ion beam at a target, a vacuum pumping system having a suction pump for evacuating the inside of the instrument, a suction path for placing the instrument in communication with the vacuum pumping system, a vibration-isolating portion placed in the suction path, and a flexible path member mounted in the vibration-isolating portion (see, for example, in JP-A-2007-165232 (paragraphs 0012-0034; FIG. 2)). This system has a contraction-hindering means which suppresses the flexible path member from contracting in such a direction that the instrument and the vacuum pumping system are drawn toward each other by suction of the vacuum pumping system.

As described previously, in some cases, low-frequency vibrations are not sufficiently removed but transmitted to the body flange, thus adversely affecting the apparatus to be pumped. Furthermore, it is conceivable to arrange plural vibration isolators in series to enhance the vibration-removing rate. In this case, a long vibration-removing assembly is built, so that this structure cannot be applied to the case where a sufficient space cannot be secured in the height direction.

SUMMARY OF THE INVENTION

In view of these problems, the present invention has been made. It is an object of the invention to provide a connector device which is for use with a turbomolecular pump (TMP) and which can sufficiently suppress transmission of vibrations of relatively low frequencies without increasing the size of the device. It is another object of the invention to provide a TMP adapted to be used with this connector device.

The foregoing problems are solved by the teachings of the present invention using the following configurations.

(1) A first embodiment of the present invention provides a connector device for use with a TMP having a rotor, a casing accommodating the rotor therein, and an intake port and an outlet port formed in the casing. The TMP sucks gas from the intake port and expels the gas from the outlet port by rotating the rotor within the casing at high speed. The connector device has a connecting exhaust tube for connecting the intake port of the TMP with an outlet port of a vacuum vessel to be pumped. An annular weight is disposed around the outer periphery of the connecting exhaust tube. A viscoelastic member is interposed between the connecting exhaust tube and the weight.

(2) A second embodiment of the present invention is based on the first embodiment and further characterized in that a bellows is mounted in an intermediate portion of the connecting exhaust tube and that the weight is disposed between the bellows and the intake port.

(3) A third embodiment of the invention is based on the first or second embodiment and further characterized in that spaces not containing the viscoelastic member are formed between the connecting exhaust tube and the weight.

(4) A fourth embodiment of the invention is based on the third embodiment and further characterized in that the viscoelastic member is divided into parts which are spaced apart from each other between the casing and the weight.

(5) A fifth embodiment of the invention is based on any one of the first through fourth embodiments and further characterized in that the weight is divided into parts between which viscoelastic members are interposed to form an integrated annular unit.

(6) A sixth embodiment of the invention provides a TMP having a rotor, a casing accommodating the rotor therein, and an intake port and an outlet port formed in the casing. The TMP sucks gas from the intake port and expels the gas from the outlet port by rotating the rotor within the casing at high speed. An annular weight whose center is coincident with the center of rotation of the rotor is disposed around the outer periphery of the casing. The viscoelastic member is interposed between the casing and the annular weight.

(7) A seventh embodiment of the invention is based on the sixth embodiment and further characterized in that the annular weight is disposed closer to the intake port than the position of the center of weight of the TMP.

(8) An eighth embodiment of the invention is based on the sixth or seventh embodiment and further characterized in that spaces not containing the viscoelastic member are formed between the casing and the weight.

(9) A ninth embodiment of the invention is based on the eighth embodiment and further characterized in that the viscoelastic member is divided into parts which are spaced apart from each other between the casing and the weight.

(10) A tenth embodiment of the invention is based on any one of the sixth through ninth embodiments and further characterized in that the weight is divided into parts between which viscoelastic members are interposed to form an integrated annular unit.

The present invention yields the following advantageous effects.

(1) According to the first embodiment of the invention, there is provided the connector device for use with the TMP having the rotor, the casing accommodating the rotor therein, and the intake port and outlet port formed in the casing. The TMP sucks gas from the intake port and expels the gas from the outlet port by rotating the rotor within the casing at high speed. The connector device has the connecting exhaust tube for connecting the intake port of the TAP with the outlet port of a vacuum vessel to be pumped. The annular weight is disposed around the outer periphery of the connecting exhaust tube. The viscoelastic member is interposed between the connecting exhaust tube and the weight. Since the vibration absorber operating over a relatively wide band of frequencies and made up of the weight and viscoelastic member is mounted, transmission of vibrations of relative low frequencies can be suppressed sufficiently by setting the resonant frequency of the vibration absorber at a relatively low frequency.

(2) According to the second embodiment of the invention, the weight is disposed between the bellows and the intake port. Consequently, vibrations of the intake flange of the TMP can be effectively suppressed. Transmission of the vibrations to the vacuum vessel to be pumped can be suppressed.

(3) According to the third embodiment of the invention, the apparent spring constant of the viscoelastic member can be adjusted by appropriately selecting the size or positions of the spaces not containing the viscoelastic member.

(4) According to the fourth embodiment of the invention, the viscoelastic member is divided into the parts which are spaced apart from each other. Therefore, the apparent spring constant of the viscoelastic member can be made lower than where the viscoelastic member is not divided into parts. The resonant frequency of the vibration absorber consisting of the weight and viscoelastic member can be adjusted to a desirable, relatively low frequency.

(5) According to the fifth embodiment of the invention, the natural frequency of the weight can be increased. In consequence, a range of frequencies at which the ratio of removal of vibrations is deteriorated due to the resonance of the weight can be shifted to frequencies higher than frequencies at which the effects on the vessel to be pumped are small.

(6) According to the sixth embodiment of the invention, the annular weight whose center is coincident with the center of rotation of the rotor is disposed around the outer periphery of the casing. This can bring the center of inertia of vibrations of the TMP into agreement with the center of the force acted on by the vibration absorber. Hence, the vibrations can be damped efficiently.

(7) According to the seventh embodiment of the invention, the annular weight is disposed closer to the intake port than the position of the center of weight of the TMP. Therefore, vibrations of the intake flange can be suppressed. Transmission of vibrations can be suppressed efficiently.

(8) According to the eighth embodiment of the invention, the apparent spring constant of the viscoelastic member can be adjusted by appropriately selecting the size or positions of the spaces not containing the viscoelastic member.

(9) According to the ninth embodiment of the invention, the viscoelastic member is divided into the parts which are spaced apart from each other. Therefore, the apparent spring constant of the viscoelastic member can be made lower than where the viscoelastic member is not divided into parts. The resonant frequency of the vibration absorber consisting of the weight and the viscoelastic member can be adjusted to a desirable, relatively low frequency.

(10) According to the tenth embodiment of the invention, the natural frequency of the weight can be increased. In consequence, a range of frequencies at which the ratio of removal of vibrations is deteriorated due to the resonance of the weight can be shifted to frequencies higher than frequencies at which the effects on the vessel to be pumped are small.

Other objects and features of the invention will appear in the course of the description thereof; which follows.

DESCRIPTION OF THE PREFERRED EMBODIMENTS

Embodiments of the present invention are hereinafter described in detail.

Figure 1B:
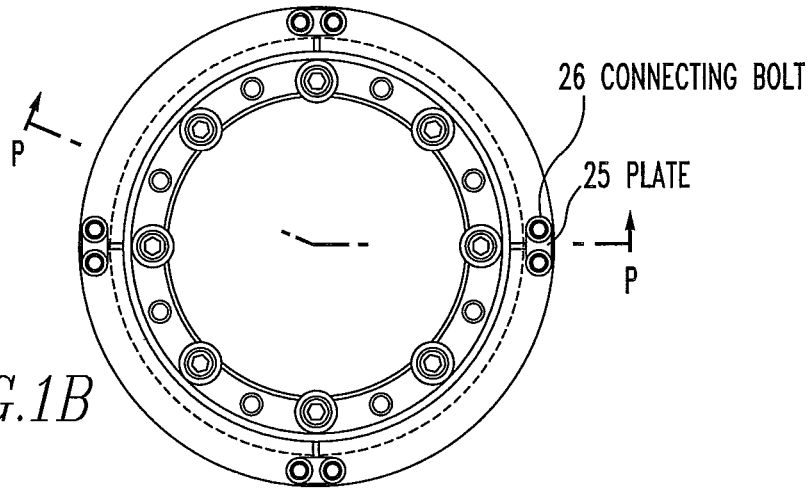
FIGS. 1A and 1B show the structure of a turbomolecular pump according to one embodiment of the present invention.
Figure 1A:
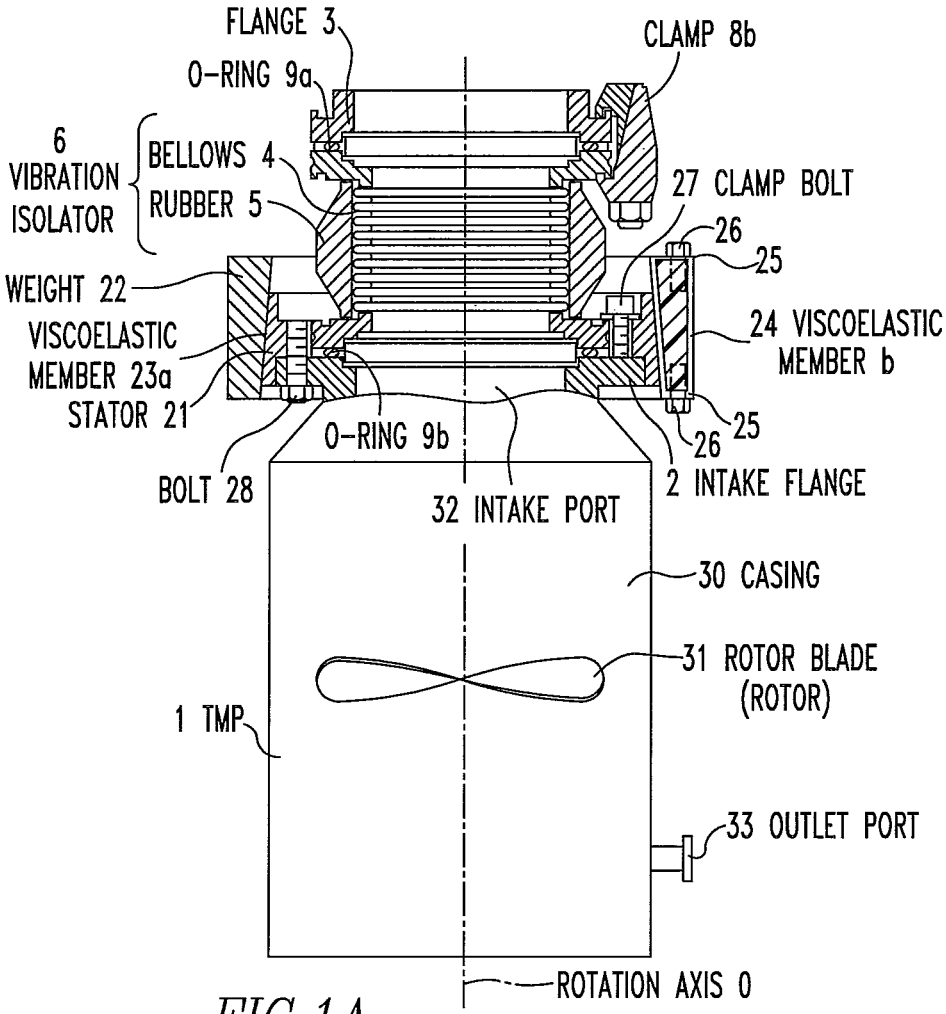
Figure 5:
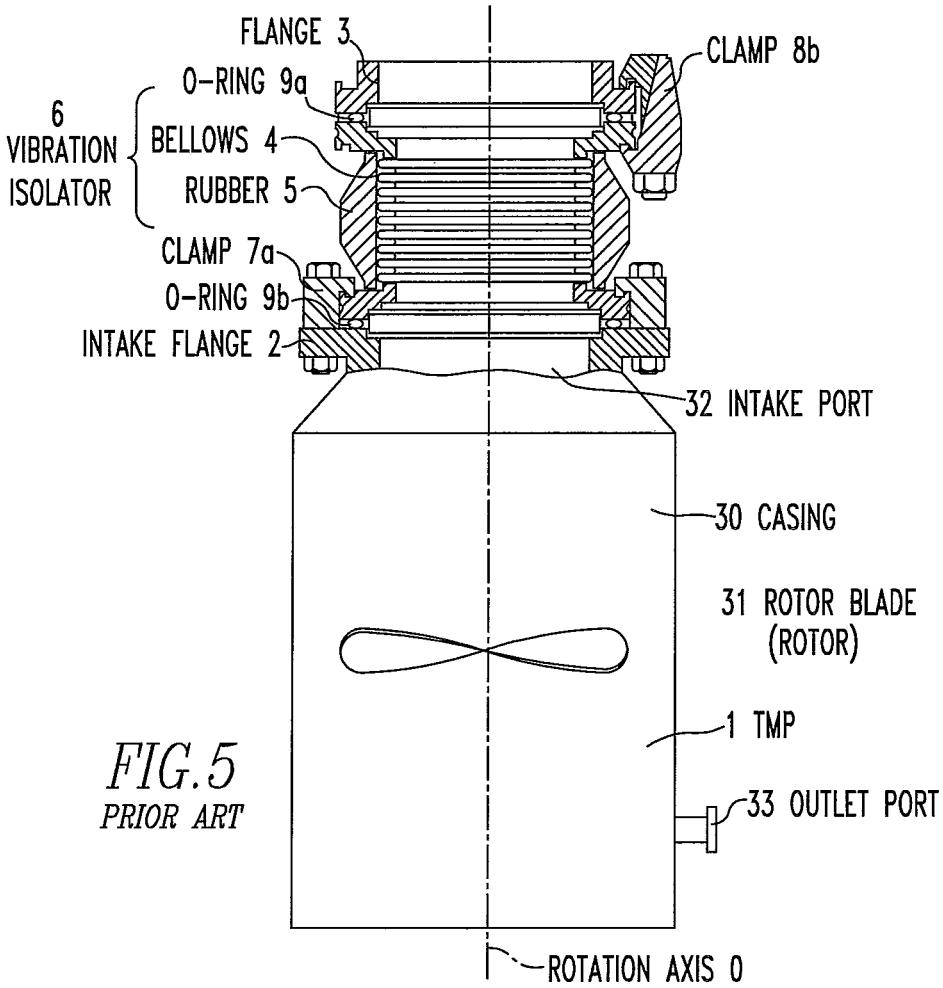
FIG.5 PRIOR ART
FIG. 5 is a side elevation partially in cross section of a conventional turbomolecular pump.
Figure 6:
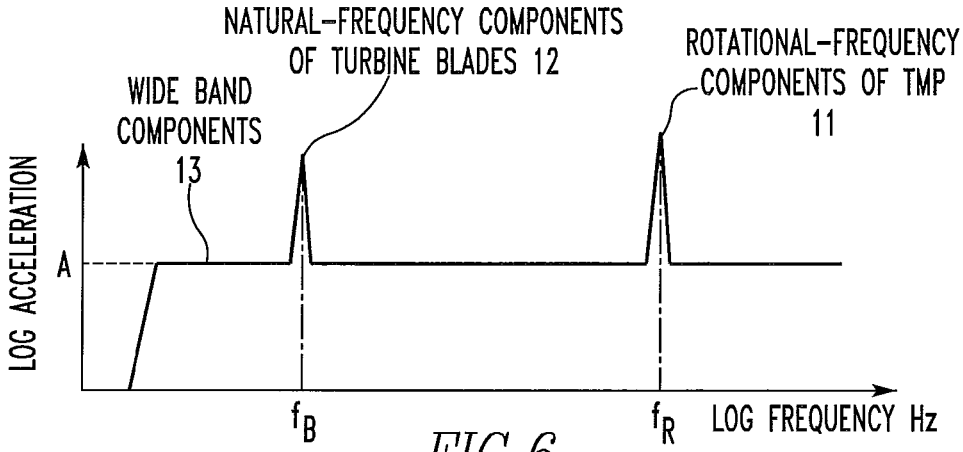
FIG. 6 is a diagram showing a spectrum of vibrations produced by a turbomolecular pump.
Figure 7:
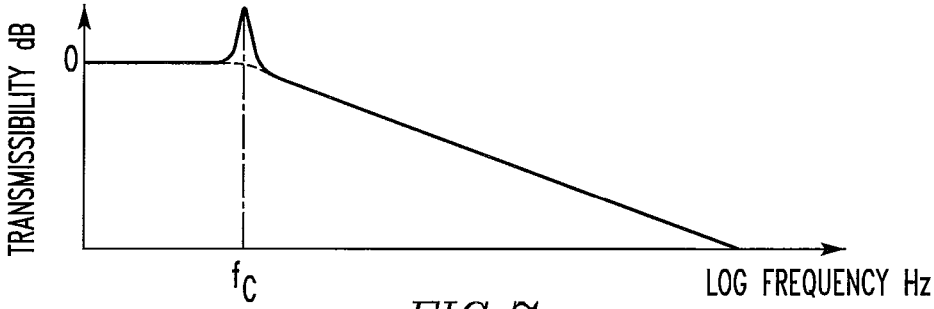
FIG. 7 is a diagram showing a vibration transfer function of a vibration isolator.

FIGS. 1A and 1B show the structure of a turbomolecular pump (TMP) according to one embodiment of the present invention. In FIGS. 1A, 1B, and 5, like components are indicated by like reference numerals. FIG. 1A is a side elevation partially in cross section of the TMP. FIG. 1B is a plan view showing the structure of a stator and a weight (described later). The cross section through the stator and weight in the side elevation is taken on line P-P of the plan view. The structure of FIG. 1A is similar to the structure of FIG. 5 except that the inner fringes of a cylindrical stator 21 are squeezed in the connector portion between the intake flange 2 of the TMP 1 and the flange of the bellows 4 on the TMP side, that a cylindrical weight 22 is disposed around the outer periphery of the stator 21, and that a viscoelastic member 23 is interposed between the inner surface of the weight 22 and the outer surface of the stator 21. The weight 22 vibrates in response to vibrations transmitted from the stator 21 via the viscoelastic member 23, thus producing damping force. As a result, the weight 22 and the viscoelastic member 23 together operate as a vibration absorber.

Figure 2:
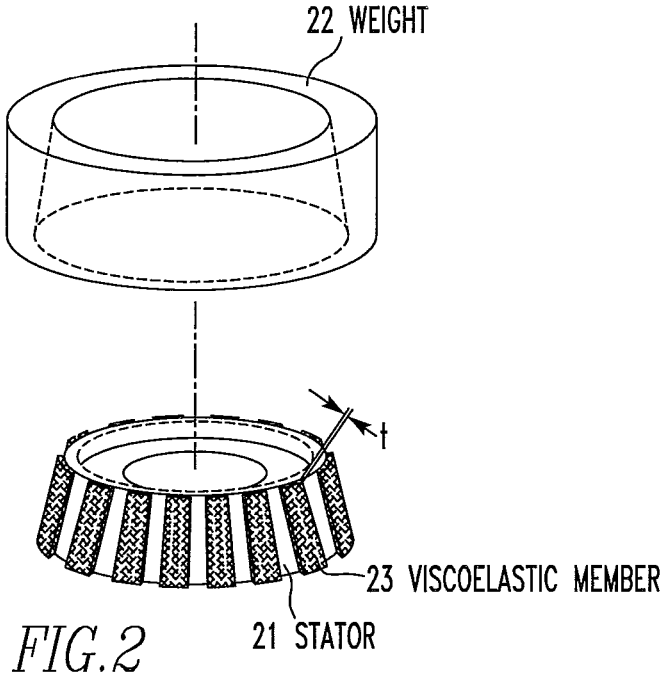
FIG. 2 is an exploded perspective view of a stator and a weight, showing their positional relationship.

The outer periphery of the stator 21 is spread downwards, as shown in FIG. 2. A belt-like viscoelastic member 23 made up of plural parts spaced apart is attached to the outer periphery of the stator 21. The inner surface of the weight 22 is also formed so as to be spread downwards in conformity with the downwardly spreading outer periphery of the stator 21. When the weight 22 is put over the stator 21, the weight 22 moves downwards by its own weight into contact with the parts of the viscoelastic member 23. As a result, the weight is supported by the stator 21 with the intervening viscoelastic member 23 therebetween. At this time, the center axis of the annular weight 22 is coincident with the axis of rotation of the rotor 31 within the TMP 1. Since most of vibrations produced by the pump 1 arise from rotation of the rotor 31, the vibrations generated by the pump 1 can be effectively canceled out by vibrating the weight 22 under the condition that the annular ring is disposed coaxially with the axis of rotation of the rotor.

Since the TMP 1 is arranged vertically and the direction of gravity is downward in the present embodiment, the weight 22 is supported to the stator 21 by the downwardly spreading structure. Therefore, the weight 22 does not come off if the stator 21 and the viscoelastic member 23 are not adhesively bonded together and the viscoelastic member 23 and the weight 22 are not adhesively bonded together.

However, where the TMP 1 is placed laterally, the gravity force cannot be utilized and so it is necessary that the weight 22 be securely supported by the stator 21 by bonding together the stator 21 and the viscoelastic member 23 and bonding together the viscoelastic member 23 and the weight 22 via appropriate adhesive members.

It may be conceivable to arrange the viscoelastic member 23 in the gap between the stator 21 and the weight 22 continuously over the whole periphery. In this case, deformation of the viscoelastic member 23 would be hindered to thereby suppress vibrations (motion) of the weight 22. This would reduce the latitude in designing the frequency characteristics of the damping force. In the present embodiment, the plural parts of the belt-like viscoelastic member 23 are spaced apart from each other and, therefore, the individual parts of the viscoelastic member 23 can easily deform. The thickness, width, and length of the belt-like viscoelastic member 23, the spading between the parts of the viscoelastic member 23, the total area of the parts, and so on can be appropriately adjusted. This offers wide latitude in designing the frequency characteristics of the damping force.

In brief, to permit the viscoelastic member 23 to deform easily, spaces not containing the viscoelastic member 23 should be formed in the gap between the stator 21 and the weight 22. The parts of the viscoelastic member 23 may be arranged to be spaced from each other. Alternatively, the viscoelastic member 23 may be made of one sheet provided with holes of arbitrary shape and wound around the whole outer periphery of the stator 21.

The weight 22 is divided into four parts after being machined into a cylindrical form. Then, the parts are reassembled into one unit. A viscoelastic material b (viscoelastic member 24) is squeezed in the gaps between the adjacent parts. The adjacent parts are connected together at the upper and lower surfaces by the use of a thin-walled plate 25 having low bending rigidity and connecting bolts 26. As a whole, the parts are assembled as a cylindrical unit. Instead of the plate, wires softer than the plate may be used to connect together the parts of the viscoelastic member 23. The operation of the pump 1 constructed in this way is described below.

The resonant frequency of the vibration absorber, formed by the viscoelastic member 23 (viscoelastic member a) and the weight 22, in the horizontal direction is determined by the mass of the weight 22 and the spring constant of the viscoelastic member 23 in the direction of compression. Therefore, the resonant frequency of the vibration absorber can be adjusted using the mass of the weight 22, the hardness, the thickness, or the area of the viscoelastic member 23. The resonant frequency remains the same whether or not the weight 22 is divided into parts for the following reason. The area of the viscoelastic member 23 with which the parts of the weight 22 are in contact decreases in inverse proportion to the number of the parts of the weight and, therefore, the ratio of the mass of the divided weight to the spring constant remains constant.

Similarly, the resonant frequency of the vibration absorber in the vertical direction is determined by the mass of the weight 22 and the spring constant of the viscoelastic member 23 in the shear direction. In the following description, only the resonant frequency in the vertical direction is treated.

Figure 3:
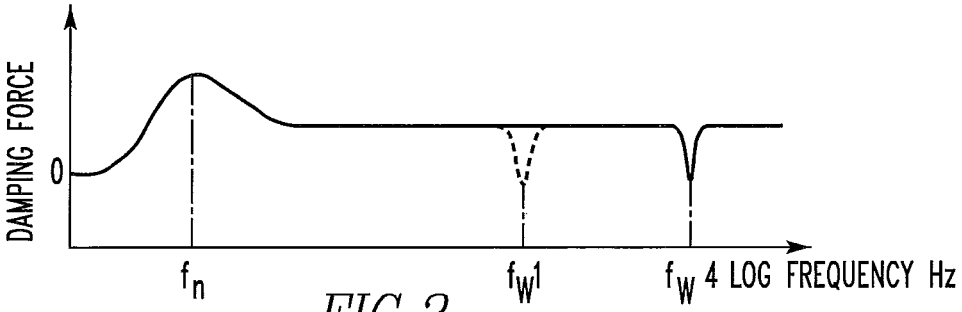
FIG. 3 is a diagram illustrating the frequency characteristics of the damping force of a vibration absorber.

FIG. 3 is a diagram showing the frequency characteristics of the damping force of the vibration absorber. In FIG. 3, frequency is plotted on the horizontal axis on a logarithmic scale. The damping force is plotted on the vertical axis. It can be seen that the damping force increases at the resonant frequency $f_n$ of the vibration absorber. The effects of transmission of vibrations can be effectively suppressed by adjusting the resonant frequency $f_n$ of the vibration absorber according to a frequency (in a relatively low frequency range in the present embodiment) that is most sensitive to the vessel to which the TMP 1 is coupled.

Figure 4:
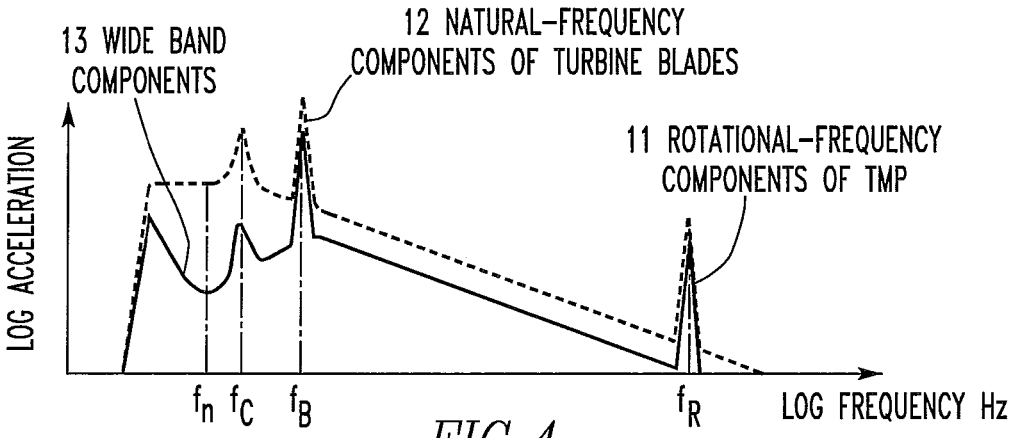
FIG. 4 is a diagram illustrating spectra of vibrations transmitted to an apparatus to which a turbomolecular pump is coupled.
Figure 8:
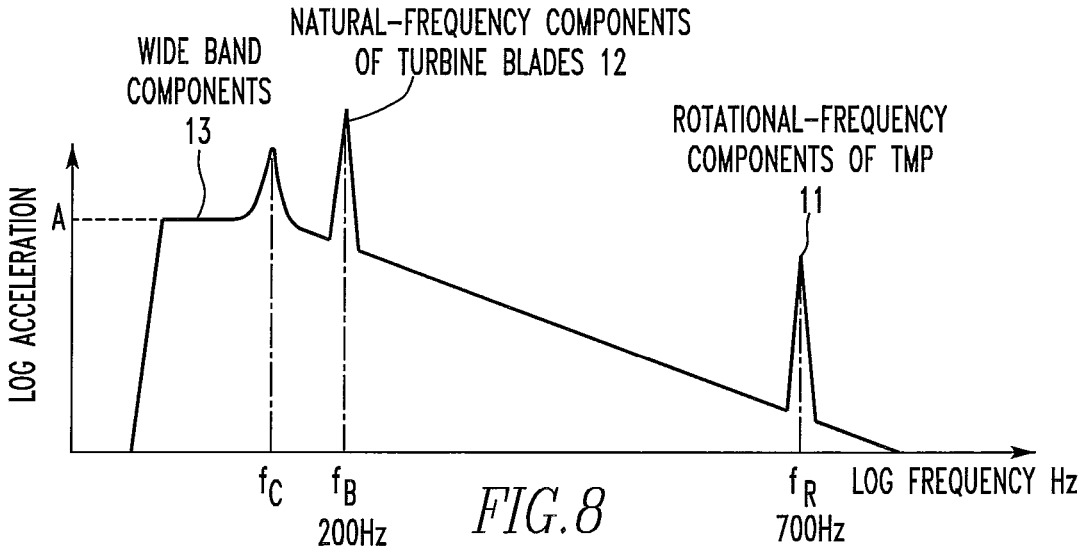
FIG. 8 is a diagram showing a spectrum of vibrations transmitted to the body of an apparatus.

As can be observed from FIG. 3, the damping force of the vibration absorber consisting of the weight 22 and the viscoelastic member 23 is not null at frequencies higher than the resonant frequency $f_n$ but has some degree of value. Accordingly, as shown in FIG. 4, vibrations transmitted to the apparatus to which the TMP 1 is coupled attenuate over a wide band of frequencies. FIG. 4 shows spectra of vibrations transmitted to the apparatus to which the TMP 1 is coupled. Frequency is plotted on the horizontal axis on a logarithmic scale. Acceleration is plotted on the vertical axis on a logarithmic scale. The broken line indicates a spectrum of vibrations obtained when the vibration absorber does not exist (in the same way as in the case of FIG. 8). It can be seen that vibrations of low frequencies at which the acceleration was great in FIG. 8 can be attenuated greatly by setting the resonant frequency $f_n$ at a low frequency that cannot be easily suppressed with the vibration isolator 6. Vibrations consisting of the rotational-frequency components of the turbomolecular pump 11 are further suppressed from being transmitted by the absorber 22, 23.

As described previously, the resonant frequency $f_n$ of the vibration absorber can be set at will by appropriately selecting the mass of the weight 22 and the spring constant of the viscoelastic member 23. On the other hand, the weight 22 constituting the vibration absorber vibrates also at its natural frequency $f_w$, at which the damping force drops. The natural frequency $f_w$ has a value determined by the geometric shape, density, Young's modulus, and Poisson's ratio of the weight 22. As an example, let this value be $f_w1$. As indicated by the broken line in the vibration-absorbing characteristics of FIG. 3, the damping force drops around the frequency $f_w1$. In the range of frequencies at which the damping force decreases, vibrations from the TMP 1 are transmitted with less attenuation to the apparatus to be pumped. Where the apparatus to be pumped is not sensitive to vibrations in this range of frequencies, no problems take place. Where the apparatus is sensitive, the apparatus may be affected greatly.

In this case, the frequency $f_w1$ can be shifted to a frequency range to which the apparatus to be pumped is not sensitive by appropriately modifying the design shape of the whole weight 22. However, the shape of the whole weight 22 is a parameter in designing the resonant frequency $f_n$. It is difficult to modify the shape freely without restrictions.

Accordingly, in the present embodiment, the weight 22 is divided into parts to modify the shape of the weight 22 such that the natural frequency is shifted toward higher frequencies than where the weight 22 is not divided. That is, in the present embodiment, the weight 22 is divided into four parts which are assembled together via the viscoelastic member 23 having a Young's modulus sufficiently lower than that of the material of the weight 22. Where each part of the weight 22 has some latitude in vibrating, the natural frequency $f_w$, attributed to the weight has a value determined by the geometric shape of each part. As the natural frequency goes higher with reducing the geometric shape, the natural frequency $f_w$ can be shifted to a higher-frequency range to which the apparatus to be pumped is not sensitive, by dividing the weight 22 into parts of smaller geometric shape or length.

In the present embodiment, the number of division is set to four. Under this condition, let $f_w4$ be the value of the natural frequency. As shown near the right end of the characteristic curve of the damping force of FIG. 3, the range of frequencies at which the damping force drops due to natural vibration of the parts of the weight 22 has been successfully shifted to a range of frequencies much higher than $f_w1$ (indicated by the broken line). It is practical to minimize the number of division to avoid the structure from being complicated. Preferably, a minimum number of division is selected while taking account of the range of frequencies to which the apparatus to be pumped is sensitive.

Since the plate 25 interconnecting the parts of the weight 22 and the viscoelastic members 23, 24 in contact with the weight 22 are low in rigidity, these components hardly vary vibrations of relatively high frequencies, such as on the order of kHz. Therefore, when the natural frequency of the weight 22 divided into parts is found computationally, the frequency may be found based on the mass of each part of the weight 22. The presence of the plate 25 and the viscoelastic members 23, 24 can be neglected practically.

Figure 9:
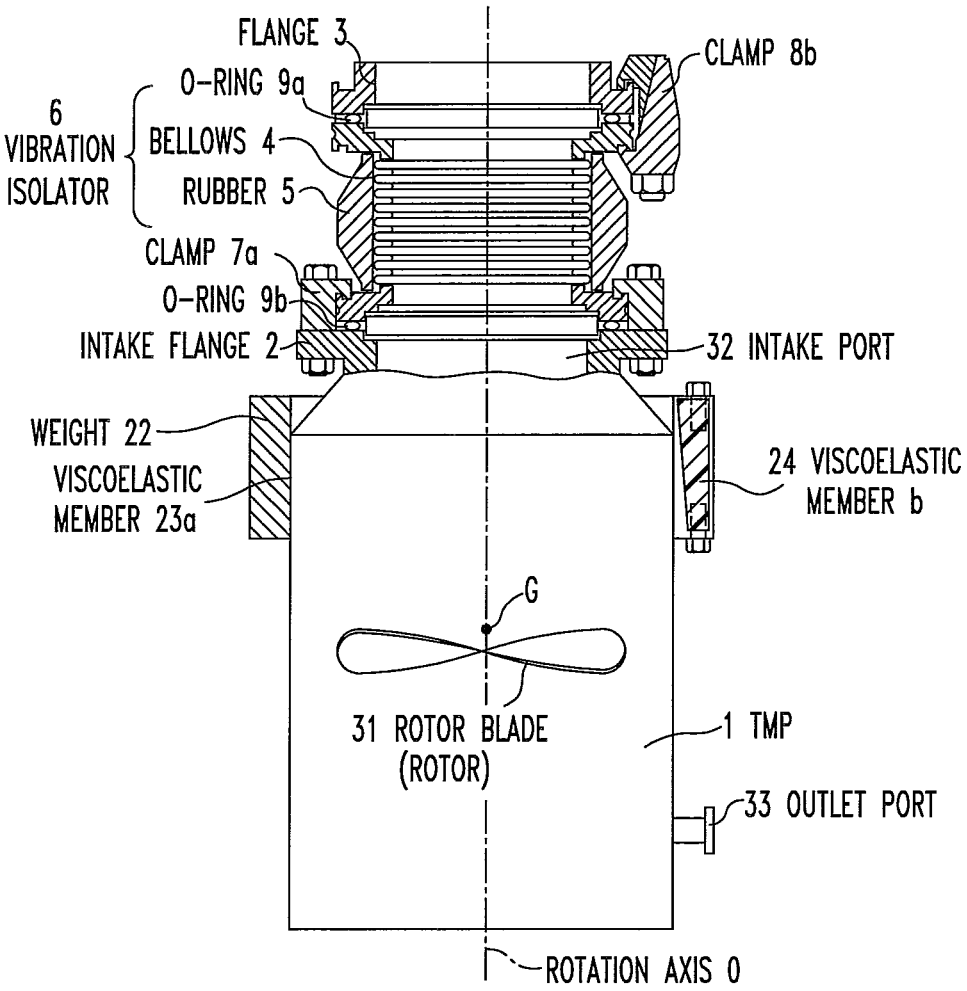
FIG. 9 is a side elevation partially in cross section of a turbomolecular pump according to another embodiment of the present invention.

FIG. 9 is a side elevation of a TMP 1 according another embodiment of the present invention. In FIGS. 1A, 1B, 5, and 9, like components are indicated by like reference numerals. In the embodiment of FIGS. 1A and 1B, the vibration absorber is attached to the connecting tube that couples together the TMP 1 and the connecting device. In the present embodiment, the vibration absorber is directly coupled to the TMP 1.

In particular, the outer surface close to the intake port 32 of the TMP 1 is formed so as to be spread downwards as shown in FIG. 9. Parts of a belt-like viscoelastic member 23 which are spaced apart from each other are attached to the outer periphery. The inner surface of an annular weight 22 is formed so as to be spread downwards in conformity with the outer periphery. When the weight 22 is put over the outer periphery, the weight 22 falls into contact with the parts of the viscoelastic member 23 by its own weight and is supported by the outer periphery of the TMP 1 with the intervening viscoelastic member 23 therebetween. At this time, the center axis 0 of the annular weight 22 is coincident with the axis of rotation of the rotor 31 inside the TMP 1.

The vibration absorber made up of the weight 22 and the viscoelastic member 23 is exactly identical in operation with the vibration absorber shown in FIG. 1A. Since vibrations generated by the TMP 1 are suppressed at the stage of the pump 1 by absorption performed by the vibration absorber, transmission of the vibrations to the pumped apparatus coupled via the intake port 32 is suppressed.

The vibration-absorbing effect can be obtained wherever the weight 22 is mounted within the TMP 1. Where the main purpose is to suppress vibrations transmitted to the apparatus to be pumped, it is desired to place the weight in a position closer to the intake port 32 than the center of gravity G of the TMP 1 alone.

The present invention described so far yields the following advantageous effects.

1) An annular weight 22 is disposed so as to surround the outer periphery of a connecting exhaust tube that couples a TMP 1 to an apparatus to be pumped. A viscoelastic member 23 is interposed between the connecting exhaust tube and the weight 22 to form a vibration absorber. Consequently, a TMP 1 connecting device is offered which can effectively suppress vibrations of relatively low frequencies to which the apparatus to be pumped is sensitive from being transmitted to the apparatus to be pumped, the vibrations being included in vibrations generated by the TMP 1.

2) Where deterioration of the absorbing force characteristics due to the natural frequency of the weight 22 is caused in a frequency range undesirable for the apparaths to be pumped, the weight 22 is divided into parts to increase the natural frequency. Consequently, deterioration of the damping force characteristics can be prevented from being produced in the frequency range undesirable for the apparatus to be pumped.

3) An annular weight 22 is disposed around the outer periphery of a TMP 1. The viscoelastic member 23 is interposed between the pump and the weight to thereby form a vibration absorber. Thus, the TMP 1 is offered which itself can suppress vibrations produced by the pump through absorption of vibrations by means of the vibration absorber.

Having thus described my invention with the detail and particularity required by the Patent Laws, what is desired protected by Letters Patent is set forth in the following claims.

The invention claimed is:

1. A connector device for use with a turbomolecular pump having a rotor, a casing accommodating the rotor therein, and an intake port and an outlet port formed in the casing, the turbomolecular pump operating to suck gas from the intake port and to expel the gas from the outlet port by rotating the rotor within the casing at high speed, said connector device comprising:

a connecting exhaust tube for connecting the intake port of the turbomolecular pump with an outlet port of a vacuum vessel to be pumped;

an annular weight disposed around an outer periphery of the connecting exhaust tube;

a viscoelastic member interposed between the connecting exhaust tube and the weight, wherein spaces not containing said viscoelastic member are formed between the connecting exhaust tube and the weight, and wherein said viscoelastic member is divided into parts which are spaced apart from each other between the connecting exhaust tube and the weight.

2. A connector device for use with a turbomolecular pump as set forth in claim 1, wherein said connecting exhaust tube has an intermediate portion in which a bellows is mounted, and wherein said weight is disposed between the bellows and the intake port.

3. A connector device for use with a turbomolecular pump as set forth in any one of claim 1 or 2, wherein said weight is divided into parts between which viscoelastic members are interposed to form an integrated annular unit.

4. A turbomolecular pump having a rotor, a casing accommodating the rotor therein, and an intake port and an outlet port formed in the casing, the turbomolecular pump operating to suck gas from the intake port and to expel the gas from the outlet port by rotating the rotor within the casing at high speed, said turbomolecular pump comprising:

an annular weight whose center is coincident with a center of rotation of the rotor, the weight being disposed around an outer periphery of the casing;

a viscoelastic member interposed between the casing and the annular weight, wherein spaces not containing said viscoelastic member are formed between the casing and the weight, and wherein said viscoelastic member is divided into parts which are spaced apart from each other between the casing and the weight.

5. A turbomolecular pump as set forth in claim 4, wherein said annular weight is disposed closer to the intake port than the position of the center of weight of the turbomolecular pump.

6. A turbomolecular pump as set forth in any one of claim 4 or 5, wherein said weight is divided into parts between which viscoelastic members are interposed to form an integrated annular unit.

* * * * *